US008491360B2

(12) United States Patent
Lefevre et al.

(10) Patent No.: US 8,491,360 B2
(45) Date of Patent: Jul. 23, 2013

(54) THREE-DIMENSIONAL NETWORK IN CMP PAD

(75) Inventors: Paul Lefevre, Topsfield, MA (US); Oscar K. Hsu, Chelmsford, MA (US); David Adam Wells, Hudson, NH (US); Marc C. Jin, Boston, MA (US); John Erik Aldeborgh, Boxford, MA (US)

(73) Assignee: Innopad, Inc., Wilmington, MA (US)

( * ) Notice: Subject to any disclaimer, the term of this patent is extended or adjusted under 35 U.S.C. 154(b) by 1203 days.

(21) Appl. No.: 12/256,886

(22) Filed: Oct. 23, 2008

(65) Prior Publication Data

US 2009/0137121 A1 May 28, 2009

Related U.S. Application Data

(60) Provisional application No. 60/983,042, filed on Oct. 26, 2007.

(51) Int. Cl.
*B24D 3/34* (2006.01)

(52) U.S. Cl.
USPC ..... 451/532; 451/536

(58) Field of Classification Search
USPC ..... 451/41, 56, 532, 533, 536, 539
See application file for complete search history.

(56) References Cited

U.S. PATENT DOCUMENTS

| | | | | |
|---|---|---|---|---|
| 6,454,634 | B1 * | 9/2002 | James et al. | 451/41 |
| 6,656,018 | B1 * | 12/2003 | Hsu et al. | 451/41 |
| 6,989,117 | B2 * | 1/2006 | Chen et al. | 264/102 |
| 2002/0077034 | A1 * | 6/2002 | Tolles | 451/41 |
| 2004/0089520 | A1 * | 5/2004 | Hymes et al. | 198/846 |
| 2004/0259484 | A1 | 12/2004 | Prasad et al. | |
| 2005/0255794 | A1 * | 11/2005 | Vangsness et al. | 451/36 |

FOREIGN PATENT DOCUMENTS

CN 101327577 12/2008

OTHER PUBLICATIONS

International Search Report and Written Opinion dated Jun. 4, 2009 issued in related International Patent Application No. PCT/US2008/080935.

Office Action from corresponding Chinese Appln. No. 200980156797.1 dated Mar. 27, 2013. English translation of relevant portions of Office Action attached.

* cited by examiner

*Primary Examiner* — Maurina Rachuba

(74) *Attorney, Agent, or Firm* — Grossman, Tucker, Perreault & Pfleger, PLLC

(57) ABSTRACT

The present disclosure is directed at a chemical-mechanical planarization polishing pad comprising interconnecting elements and a polymer filler material, wherein the interconnecting elements include interconnecting junction points that are present at a density of 1 interconnecting junction point/$cm^3$ to 1000 interconnecting junction points/$cm^3$, and wherein the interconnecting elements have a length between interconnection junction points of 0.1 microns to 20 cm.

28 Claims, 1 Drawing Sheet

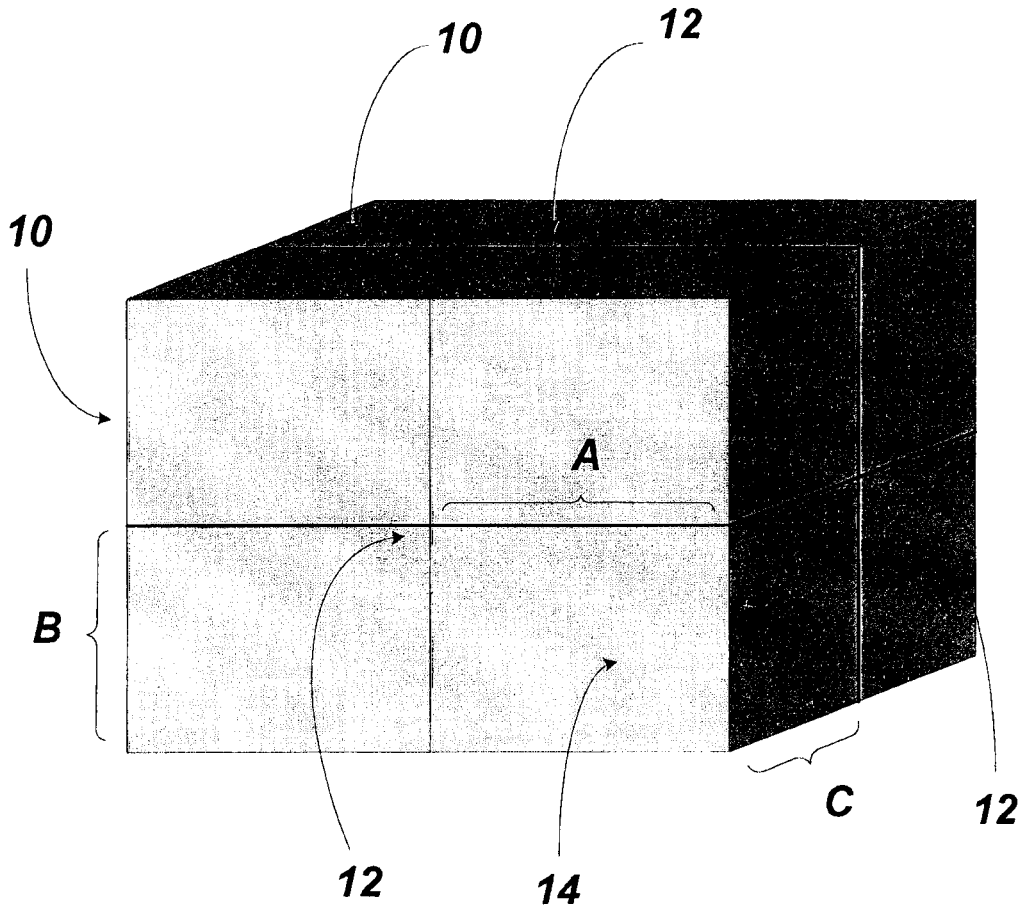
10
12
10
A
B
C
12
12
14

THREE-DIMENSIONAL NETWORK IN CMP PAD

CROSS-REFERENCE TO RELATED APPLICATIONS

This application claims the benefit of U.S. Provisional Patent Application Ser. No. 60/983,042, filed on Oct. 26, 2007, which is fully incorporated herein by reference.

TECHNICAL FIELD

The present invention relates to polishing pads useful in Chemical-Mechanical Planarization (CMP) of semiconductor wafers.

BACKGROUND INFORMATION

Conventional polishing pads for CMP comprise a first porous or solid polymeric substance which may be inter-dispersed with a second filler substance. A commonly used conventional pad, for example, comprises a solid polyurethane matrix inter-dispersed with hollow microspheres. However, there is a need for pads which provide better global uniformity and local planarity of the polished semiconductor wafer, as well as improved mechanical properties when employed in the polishing environment.

SUMMARY

In a first exemplary embodiment, the present disclosure is directed at a chemical-mechanical planarization polishing pad comprising interconnecting elements and a polymer filler material, wherein the interconnecting elements include interconnecting junction points that are present at a density of 1 interconnecting junction point/$cm^3$ to 1000 interconnecting junction points/$cm^3$, and wherein the interconnecting elements have a length between interconnection junction points of 0.1 microns to 20 cm.

In method form, the present disclosure relates to a method of polishing a semiconductor wafer, comprising providing interconnecting elements and a polymer filler material and forming a pad, wherein the interconnecting elements include interconnecting junction points that are present at a density of 1 interconnecting junction point/$cm^3$ to 1000 interconnecting junction points/$cm^3$, and wherein the interconnecting elements have a length between interconnection junction points of 0.1 microns to 20 cm. Such pad configuration may then be positioned on a polishing device followed by the introduction of slurry and polishing a semiconductor wafer.

BRIEF DESCRIPTION OF THE DRAWINGS

These and other features and advantages will be better understood by reading the following detailed description, taken together with the drawings wherein:

FIG. 1 is a view of a portion of the three-dimensional structure with a given pad.

DETAILED DESCRIPTION

A portion of the three-dimensional structure with a given pad is shown in FIG. 1. As can be seen, it may include interconnecting elements 10 along with a plurality of junction locations 12. The interconnecting elements may be a polymeric material. Within the three-dimensional structure (i.e. the interstices) may be a particular polymeric filler material

14 which, when combined with the three-dimensional interconnecting elements 10, provide the polishing pad substrate. In addition, although the network is shown with a relative square or rectangular geometry, it may be appreciated that it may include other types of structure, including, but not limited to oval, round, polyhedral, etc.

The polymeric filler material and the interconnecting elements may therefore be sourced from, but not be limited to, a variety of specific polymeric resins. For example, the polymeric resins may include poly(vinyl alcohol), polyacrylate, polyacrylic acids, hydroxyethylcellulose, hydroxymethylcellulose, methylcellulose, carboxymethylcellulose, polyethylene glycol, starch, maleic acid copolymer, polysaccharide, pectin, alginate, polyurethane, polyethylene oxide, polycarbonate, polyester, polyamide, polypropylene, polyacrylamide, polyamide, polyolefins as well as any copolymers and derivatives of the above resins.

In addition, a further aspect of this invention is the use of multiple three-dimensional structural networks to affect different physical and chemical property domains within the same pad. Accordingly, one may vary the chemical (polymeric) composition noted above for the elements 10 and/or physical features of the three-dimensional network. Such physical features may include the spacing within the network, and or the overall shape of the network, as explained more fully below.

It is worth noting that advanced semiconductor technology requires packing a large number of smaller devices on the semiconductor wafer. Greater device density in turn requires greater degrees of local planarity and global uniformity over the wafer for depth of focus reasons in photo lithography. The three-dimensional structure network in the present invention may therefore enhance the mechanical and dimensional stability of the CMP pad over conventional, non-network based CMP pad structures. The three-dimensional structure network herein may also better withstand the compressive and viscous shear stress of the polishing action, resulting in the desired degree of local planarity and global uniformity as well as low wafer scratching defects, as the surface deformation of the pad is reduced.

As alluded to above, the actual three-dimensional structural network can also be customized for a particular CMP application by varying the type of polymeric materials, the dimensions of the interconnecting elements, and the size and shape of the network. In addition, various chemical agents including, but not limited to, surfactants, stabilizers, inhibitors, pH buffers, anti-coagulants, chelating agents, accelerators and dispersants may be added to the surface or bulk of the interconnecting elements of the network, so that they can be released in a controlled or uncontrolled manner into an abrasive slurry or polishing fluid to enhance CMP performance and stability.

Commercially available materials for the three-dimensional structural network and the polymer interconnecting elements include, but are not limited to, woven, knitted and nonwoven fiber mats, high-loft nonwovens. As may be appreciated, such networks are fiber based. However, the interconnecting elements may also include open-cell polymeric foams and sponges, polymeric filters, grids and screens. Non-commercial structural networks can readily be designed and manufactured by those who are skilled in the art of manufacturing nonwovens, foams, sponges, filters and screens, to meet the design intent and property requirements of the network for a CMP pad of the present disclosure, as described herein.

One exemplary embodiment of the present invention comprises a polyurethane substance dispersed and partially or completely filling the interstices of a three-dimensional network made up of water-soluble polyacrylate interconnecting elements. The interconnecting elements within said network may have a cylindrical shape with diameters from below 1 micron to about 1000 microns, and what may be described as a horizontal length between adjacent interconnecting junctures ranging from 0.1 microns and higher (e.g. junctures with a horizontal length therebetween ranging from 0.1 microns to 20 cm, including all values and increments therein). This length between interconnecting junctures is shown as item "A" in FIG. 1. In addition, what may be described as the vertical distance between interconnecting junctures is shown as item "B" in FIG. 1, and this may also vary as desired from 0.1 microns and higher (e.g., junctures having a vertical length therebetween ranging from 0.1 microns to 20 cm, including all values and increments therein). Finally, in what may described as a depth distance between junctures is shown as item "C" in FIG. 1, and again, this may also vary as desired from 0.1 microns and higher (e.g. junctures having a depth distance therebetween ranging from 0.1 microns to 20 cm, including all values and increments therein). Preferably, the length between junction points as item "A", "B" or "C" in FIG. 1 may be in the range of 0.5 microns to 5 cm.

Reference herein to a three-dimensional network may therefore be understood as interconnecting elements (e.g. polymeric fibers) which may be interconnected at a junction point, which interconnected elements occupy some amount of volume. The density of the interconnecting junction elements may be present at a level of 1 interconnecting junction point/$cm^3$ to 1000 interconnecting junction points/$cm^3$, including all values and increments therein, at 1 interconnecting junction point/$cm^3$ variation. For example, the polishing pad may have 1-100 interconnecting junction points/$cm^3$, or 10-110 interconnecting junction points/$cm^3$, or 15-150 interconnecting junction points/$cm^3$, etc. Preferably, the interconnecting elements may be present in the range of 50-250 interconnecting junction points/$cm^3$. The interconnects themselves may be formed by, e.g., thermal bonding and/or chemical bonding, which chemical bonding may be developed by polymeric filler material (see again, 14 in FIG. 1) which may serve to coat polymeric elements 10 and serve to bind the polymeric elements 10 at interconnect or junction location 12.

In addition, the interconnecting elements may be present in the pad at a level of 1-75% by weight, including all values and increments therein, at 1.0 weight percent intervals. For example, the interconnecting elements may be present in a given pad at 1-50 weight percent, or 10-50 weight percent, or 20-40 weight percent, or 20-30 weight percent, etc.

It may also be appreciated that the angle that may be formed between any two of the polymeric elements at the junction point location may be configured to vary. Reference is therefore directed again to FIG. 1, wherein it can be seen that the fibers may interconnect at a junction location with a particular angle 16. Such angle as between any two of the fibers at the interconnect junction point may be in the range of 5 degrees to 175 degrees including all values and increments therein, at 1 degree increments. For example, the angle between any two of the fibers at an interconnect junction location may be in the range of 10 degrees to 170 degrees, or 20 degrees to 160 degrees, or 30 degrees to 150 degrees, etc. Preferably the angle may be in the range of 30 degrees to 130 degrees.

The three-dimensional network of interconnecting polymer elements may be in the form of a thin square or circular slab with thickness in the range of 10 mils to 6000 mils and preferably between 60 to 130 mils, where a mil may be understood as 0.001 inches. The three-dimensional network may also define an area between 20 to 4000 square inches and preferably between 100 to 1600 square inches, including all values and increments therein. A urethane pre-polymer mixed with a curing agent may be used to fill the interstices of the said network, and the composite is then cured in an oven to complete the curing reaction of the urethane pre-polymer. Typical curing temperature ranges from room temperature to 800° F., and typical curing time ranges from as little as under an hour to over 24 hours. The resulting composite is then converted into a CMP pad using conventional pad converting processes such as buffing, skiving, laminating, grooving and perforating.

The network may also be available in the form of a cylinder or rectangular block in the above mentioned embodiment. It follows, then, that the composite comprising the network herein filled with urethane pre-polymer mixed with curing agent may also be cured in the form of a cylinder or rectangular block. In this case, the cured composite cylinder or block may first be skived to yield individual pads before converting.

Another embodiment of the present invention includes two or more networks having different thicknesses, the networks further differentiated from each other by the types of interconnecting polymeric material contained therein. For example, one network may have a thickness of 1-20 centimeters and a second network may have a thickness of 1-20 cm, each including all values and increments therein. The networks within the same CMP pad then define different structural domains having different physical and chemical properties. One example would include a CMP pad having a first 20 mils thick network comprising interconnecting elements of soluble polyacrylate in relatively small cylindrical form at 10 microns diameter and 50 to 150 microns apart from each other that is stacked onto a second network comprising relatively insoluble polyester interconnecting elements in the same cylindrical form and having the same dimensions as the first polyacrylate network. A urethane pre-polymer mixed with a curing agent may then be used to fill the interstices of the stacked networks, and the entire composite is cured as mentioned above. The resulting composite is then converted into a CMP pad using conventional pad converting processes such as buffing, skiving, laminating, grooving and perforating. The CMP pad made in this manner has therefore two distinctly different but attached structural layers stacked on one another. In CMP, the structural layer comprising the soluble polyacrylate elements may be used as the polishing layer. The soluble polyacrylate elements dissolve in the aqueous slurry containing the abrasive particles, leaving void spaces on and under the surface of the pad creating micron sized channels and tunnels for even distribution of the said slurry throughout the pad. The structural layer containing the relatively insoluble polyester elements, on the other hand, may be employed as the supporting layer to maintain mechanical stability and bulk pad properties in CMP.

In that regard, it may be appreciated that the current disclosure relates to a CMP pad containing one or more layers of interconnecting elements and polymer filler material, wherein the interconnecting elements are soluble in a liquid slurry and one or more layers of interconnecting elements and polymer filler material, wherein the interconnecting elements are insoluble in a liquid slurry. In addition, the CMP pad herein may include one or a plurality of layers where such layers themselves may include a portion of soluble interconnecting elements along with a portion of insoluble interconnecting elements. For example, in a given layer of the CMP pad, one may have 1-99% by weight soluble interconnecting elements and 99%-1% by weight insoluble interconnecting elements.

Considering then more specifically the advantageous mechanical features of the pad design herein, dynamic mechanical analysis (DMA) testing was conducted on polishing pads containing a three-dimensional network as disclosed herein as compared to polishing pad without any such reinforcement. The DMA test equipment employed was a TA Instrument Q800 Dynamic Mechanical Analyzer at a frequency of 10 Hz and at a temperature ramp speed of 1.0° C. per minute. The results of such testing are illustrated below in Table 1:

TABLE 1

| Sample Description | Weight Percent Non-Woven | Storage Modulus at 25° C. (MPa) | Loss Modulus at 25° C. (MPa) | Stiffness Newtons/meter |
|---|---|---|---|---|
| Non-woven Fabric [Interconnecting elements with polyurethane filler] | 20-30 | 1666 | 96 | 28029 |
| Polyurethane Only [no interconnecting polymer element] | 0 | 862 | 67 | 12848 |

As can be seen from Table 1, the presence of 20 weight percent to 30 weight percent of a nonwoven in a polishing pad configuration, wherein the non-woven contained interconnecting elements as described herein, indicated a storage modulus (E') value of 1666 MPa. By comparison, the same polyurethane on its own, when utilized as the polymer matrix for a polishing pad configuration, indicated an E' value of only about 862 MPa. It is therefore may be appreciated that polishing pads may now be produced having a storage modulus or E' value of 100 MPa to 2500 MPa, including all values and increments therein, in 10 MPa increments. For example, a polishing pad may now be produced having an E' value of 110 MPa to 2500 MPa, or 120 MPa to 2500 MPa, etc. Preferably, E' values may be in the range of 400-1000 MPa. In Table 1, the interconnecting elements were polyacrylate fibers made into a needle-punched nonwoven, where the fibers had an average diameter of 20 microns and which fibers were soluble in the presence of a liquid slurry. The polyurethane was initially present in the form of a liquid prepolymer precursor and was mixed with a curative before being dispensed uniformly throughout the interconnecting elements and cured, i.e. solidified to form a polishing pad.

Attention is next directed to Table 2, which identifies additional advantageous features of the pads herein. Specifically, Shore D hardness was evaluated, for a composition that incorporated the interconnecting polymer elements as compared to a composition that contained only the polymeric filler.

| Sample Description | Weight Percent Non-Woven | Shore D Hardness |
|---|---|---|
| Non-woven Fabric [Interconnecting elements with polyurethane filler] | 20-30 | 66-70 |
| Polyurethane Only [no interconnecting element] | 0 | 55-60 |

As can be seen from Table 2, the introduction of a non-woven fabric into a polyurethane filler matrix provided an increase in Shore Hardness over compositions that did not contain such reinforcement. As may be appreciated, such increase in hardness may provide a number of advantages during the polishing operation, such as resisting the compressive and viscous shear stress of the polishing action, as noted above. For example, the increase in hardness may preserve, e.g., the channels or grooves that may often be provided in a CMP type pad, which channels or grooves may be relied upon to transport slurry. More specifically, the increase in mechanical properties (e.g. the improvement in E' values noted above) may now serve to preserve the dimensions of the channels or grooves during polishing, thereby assuring that slurry transport remains at levels otherwise intended, during the entirety of a given polishing operation. In Table 2 it may be noted that the non-woven fabric was a needle-punched nonwoven of polyacrylate fibers where the fibers had an average diameter of 20 microns, which fibers were soluble in the presence of a liquid slurry. The polyurethane was in the form of a liquid prepolymer precursor and was mixed with a curative before being dispensed uniformly throughout the interconnecting elements and cured, i.e. solidified to form a polishing pad.

The aforementioned embodiments notwithstanding, it is recognized herein that one who is skilled in the art of CMP pad design, manufacture and application can readily appreciate the unexpected properties by the incorporation of the structural network into a CMP pad, and can readily derive, based on the present invention, a multitude of pad designs using the same concept with various types of network materials, structure, and polymeric substances in the same pad to meet the requirements of particular CMP applications.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A chemical-mechanical planarization polishing pad comprising:

a performed three-dimensional network of interconnecting elements and a polymer filler material, wherein said interconnecting elements include interconnecting junction points that are present at a density of 1 interconnecting junction point/$cm^3$ to 1000 interconnecting junction points/$cm^3$, and wherein said interconnecting elements have a length between interconnecting junction points of 0.1 microns to 20 cm wherein said three-dimensional network defines square or rectangular geometry that is present through-out said pad;

wherein the interconnecting elements comprise fibers;

wherein the fibers comprise fibers that are soluble in a liquid slurry; and wherein the soluble fibers dissolve in the liquid slurry leaving void spaces on and under a surface of the pad creating micron sized channels and tunnels for distribution of the liquid slurry throughout the pad.

2. The pad of claim 1 wherein the interconnecting elements are present in the pad at a level of 1.0% by weight to 75% by weight.

3. The pad of claim 1 wherein the interconnecting elements are present and define a thickness of 10 mils to 6000 mils.

4. The pad of claim 1 wherein said fibers are present in the form of a non-woven or woven material.

5. The pad of claim 1 wherein:

the interconnecting elements comprise at least one of a foam, sponge, filter, grid and screen.

6. The pad of claim 1 wherein said pad comprises:

one or more layers of interconnecting elements and polymer filler material, wherein the interconnecting elements are soluble in a liquid slurry;

one or more layers of interconnecting elements and polymer filler material, wherein the interconnecting elements are insoluble in a liquid slurry.

7. The pad of claim 1 wherein said pad comprises:

one or more layers of interconnecting elements and polymer filler material, wherein a portion of the interconnecting elements are soluble in a liquid slurry and a portion of the interconnecting elements are insoluble in a liquid slurry.

8. The pad of claim 1 wherein said pad has a storage modulus (E') value of 100 MPa to 2500 MPa.

9. The pad of claim 1 wherein said pad has a storage modulus of (E') 400 MPa to 1000 MPa.

10. The pad of claim 1 wherein the interconnecting junction points are present at a density of 1 interconnecting junction point/$cm^3$ to 250 interconnecting junction point/$cm^3$.

11. The pad of claim 1 wherein the length between interconnecting junction points is 0.5 microns to 5 cm.

12. A method of creating a chemical-mechanical planarization polishing pad comprising:

providing a performed three-dimensional network of interconnecting elements and a polymer filler material and forming a pad, wherein said interconnecting elements include interconnecting junction points that are present at a density of 1 interconnecting junction point/$cm^3$ to 1000 interconnecting junction points/$cm^3$, and wherein said interconnecting elements have a length between interconnection junction points of 0.1 microns to 20 cm wherein said three-dimensional network defines square or rectangular geometry that is present through-out said pad; and positioning said pad on a polishing device and introducing slurry and polishing a semiconductor wafer;

wherein the interconnecting elements comprise fibers;

wherein the fibers comprise fibers that are soluble in a liquid slurry; and wherein the soluble fibers dissolve in the liquid slurry leaving void spaces on and under a surface of the pad creating micron sized channels and tunnels for distribution of the liquid slurry throughout the pad.

13. The method of claim 12 wherein the interconnecting elements are present in the pad at a level of 1.0% by weight to 75% by weight.

14. The method of claim 12 wherein the interconnecting elements are present and define a thickness of 10 mils to 6000 mils.

15. The method of claim 12 wherein said fibers are present in the form of a non-woven or woven material.

16. The method of claim 12 wherein:

the interconnecting elements comprise at least one of a foam, sponge, filter, grid and screen.

17. The method of claim 12 wherein said pad comprises:

one or more layers of interconnecting elements and polymer filler material, wherein the interconnecting elements are soluble in a liquid slurry;

one or more layers of interconnecting elements and polymer filler material, wherein the interconnecting elements are insoluble in a liquid slurry.

18. The method of claim 12 wherein said pad comprises:

one or more layers of interconnecting elements and polymer filler material, wherein a portion of the interconnecting elements are soluble in a liquid slurry and a portion of the interconnecting elements are insoluble in a liquid slurry.

19. The method of claim 12 wherein said pad has a storage modulus (E') value of 100 MPa to 2500 MPa.

20. The method of claim 12 wherein said pad has a storage modulus (E') of 400 MPa to 1000 MPa.

21. The method of claim 12 wherein the interconnecting junction points are present at a density of 1 interconnecting junction point/$cm^3$ to 250 interconnecting junction point/$cm^3$.

22. The method of claim 12 wherein the length between interconnecting junction points is 0.5 microns to 5 cm.

23. The method of claim 12 wherein the fibers further comprise insoluble fibers.

24. The method of claim 23 wherein the insoluble fibers and soluble fibers are provided in distinct layers.

25. The method of claim 24 wherein the layers of insoluble and soluble fibers are within the polymer filler.

26. The pad of claim 1 wherein the fibers further comprise insoluble fibers.

27. The pad of claim 26 wherein the insoluble fibers and soluble fibers are provided in distinct layers.

28. The pad of claim 27 wherein the layers of insoluble and soluble fibers are within the polymer filler.

* * * * *